US009915493B2

(12) United States Patent
Becker

(10) Patent No.: US 9,915,493 B2
(45) Date of Patent: Mar. 13, 2018

(54) LAUNCHER DESIGNED FOR LAUNCHING CONCENTRATED OR BULBOUS MASSES

(71) Applicant: Bennet Becker, Bolton, MA (US)

(72) Inventor: Bennet Becker, Bolton, MA (US)

(73) Assignee: The Adventurers Outlet, Bolton, MA (US)

( * ) Notice: Subject to any disclaimer, the term of this patent is extended or adjusted under 35 U.S.C. 154(b) by 0 days.

(21) Appl. No.: 15/653,996

(22) Filed: Jul. 19, 2017

(65) Prior Publication Data

US 2018/0038665 A1 Feb. 8, 2018

Related U.S. Application Data

(60) Provisional application No. 62/371,353, filed on Aug. 5, 2016.

(51) Int. Cl.
*F41B 5/00* (2006.01)
*F41B 3/02* (2006.01)
*F42B 12/40* (2006.01)

(52) U.S. Cl.
CPC ..... *F41B 5/0015* (2013.01); *F41B 3/02* (2013.01); *F41B 5/00* (2013.01); *F42B 12/40* (2013.01)

(58) Field of Classification Search
CPC ..... F41B 5/00; F41B 3/02
See application file for complete search history.

(56) References Cited

U.S. PATENT DOCUMENTS 1,781,530 A 11/1930 Scott
2,026,199 A 12/1935 George
2,186,386 A * 1/1940 Lowell ..... F41B 5/143 124/24.1
2,909,167 A * 10/1959 Fredrickson ..... F41B 5/14 124/24.1
3,561,418 A * 2/1971 Fredrickson ..... F41B 5/14 124/24.1
3,630,186 A 12/1971 Babyn
3,834,368 A 9/1974 Geiger
4,759,337 A * 7/1988 Suski ..... F41B 5/14 124/24.1

(Continued)

FOREIGN PATENT DOCUMENTS

WO 2014056275 A1 4/2014
WO 2015031870 A1 3/2015
WO 2015108965 A1 7/2015

*Primary Examiner* — John Ricci

(74) *Attorney, Agent, or Firm* — Ascentage Patent Law, LLC; Travis Lee Johnson; David S. Einfeldt

(57) ABSTRACT

A concentrated mass launcher including a handle a cradle portion having a first anterior wall and a second anterior wall, the first and second anterior walls being opposed to one another and being separated from one another to form a gap, the cradle portion being positioned above the handle; an upper resilient limb extending from the cradle portion; a lower resilient limb extending downwardly from the handle; a string extending from the upper resilient limb toward the lower resilient limb; a sling being disposed about the primary string; a first resilient member being connected at a first end to the sling about a perimeter edge, and being connected to the cradle portion; and a second resilient member being connected at a first end to the sling about the perimeter edge, and being connected to the cradle portion.

19 Claims, 13 Drawing Sheets

(56) References Cited

U.S. PATENT DOCUMENTS

| | | | | |
|---|---|---|---|---|
| 4,829,974 | A | 5/1989 | Anderson | |
| 5,632,262 | A | 5/1997 | Hanson | |
| 5,649,519 | A * | 7/1997 | Linderman | F41B 5/0005 124/23.1 |
| 5,678,528 | A | 10/1997 | Hadley | |
| 6,968,835 | B2 | 11/2005 | Lee | |
| 9,239,205 | B2 | 1/2016 | Cummings | |
| 2013/0000135 | A1 | 1/2013 | Bruder et al. | |
| 2016/0153738 | A1 | 6/2016 | Cummings | |

* cited by examiner

LAUNCHER DESIGNED FOR LAUNCHING CONCENTRATED OR BULBOUS MASSES

COPYRIGHT STATEMENT

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

CROSS-REFERENCE TO RELATED APPLICATIONS

This application claims the benefit of U.S. Patent Application No. 62/371,353 filed on Aug. 5, 2016; which is herein incorporated by reference in entirety.

FIELD OF THE INVENTION

The present invention relates generally to spring or elastic style launchers, such as bows and arrow style systems as well as sling shots.

BACKGROUND

Typical bows for the use of shooting arrows come in many shapes and sizes, as well as vary in design and shape, from a traditional recurve style that relies on the elastic deformation and spring properties of the upper and lower limbs. The string attached to the distal ends, when pulled in a rear direction, causes the two distal ends to draw together and results in an elastic deformation thus storing potential energy, whereupon release of the string allows the upper and lower limbs to snap back to an original configuration drawing the string forward rapidly. Thus, transferring the stored potential energy into kinetic forward energy which causes an arrow being attached to the string to be accelerated forward. An arrow resting at the central portion of the string is then launched forward at a rapid rate upon release of the string.

While the bow and arrow style system allows for extremely high repeatability and accuracy between shots, they also have numerous limitations. For example, the draw distance is greatly limited by the shaft length of the arrow. For the system to function properly, the arrow must be able to extend from the string to where the arrow rests in the handle portion of the bow at the fully drawn distance. As such the amount of potential energy which is allowed to be stored can be significantly limited. Further, these long shafts can be difficult or otherwise cumbersome to store and transport without bending the shafts Sling shots or other sling-style launchers or shooters rely on a tensile spring action in conjunction with a pouch in order to accelerate and launch a typically smaller projectile. In such systems, the sling carrying the intended projectile is attached to a cradle using a linear style spring or resilient band system. In this way, as the sling is drawn back from the cradle, the resilient bands store potential energy similar to a bow and arrow, where, upon release, allows a conversion of potential energy to be converted into kinetic energy of the projectile and sling as the resilient bands draw back toward the cradle.

While slingshots allow for the removal of the shaft from the projectile, thus allowing for increasing the draw length, and associated power, they also have limitations which cause problems with accuracy and repeatability. Examples of some such limitations include the fact that the sling or pouch which carries the projectile can potentially envelop and interfere with the projectile upon release. Additionally, the geometry and holding positions of the sling and cradle upon draw is typically not as consistent between shots as a bow and arrow. As such, slingshots tend to be less accurate.

SUMMARY OF THE INVENTION

The present invention overcomes many of the disadvantages of the various systems of the prior art by providing a concentrated mass launcher similar in construction to a bow and arrow. Accordingly, a launcher reflective of various aspects of the present invention is disclosed herein which can include a handle and a cradle portion, the cradle portion having a first anterior wall and a second anterior wall, the first and second anterior walls being opposed to one another and being separated from one another to form a gap, the cradle portion being positioned above the handle. An upper resilient limb can also be provided which extends upwardly from the cradle portion, the upper resilient limb terminating at an upper distal end. Additionally, a lower resilient limb can be provided which extends downwardly from the handle, the lower resilient limb terminating at a lower distal end. a sling can then be provided between the upper and lower resilient limbs utilizing a first string extending from the upper distal end of the upper resilient limb toward the cradle portion, the first string connecting to an upper portion of the sling, and a second string extending from the lower distal end of the lower resilient limb toward the cradle portion, the second string connecting to a lower portion of the sling.

In addition to the first and second strings, a first resilient member can be provided which is connected at a first end to the sling about a perimeter edge, and being connected at a second end to the first anterior wall of the cradle portion as well as a second resilient member being connected at a first end to the sling about an opposing perimeter edge, and being connected at a second end to the second anterior wall of the cradle portion.

In some embodiments, the first string can be formed from an inelastic material being rigid along a primary axis of the first string. In some such embodiments, the second string can be formed of an elastic material having elastic properties along a primary axis of the second string.

In yet additional embodiments the first anterior wall and the second anterior wall can each include a respective upper and lower connection portion which connect to the upper resilient member at the upper connection portion and connect to the handle at a lower connection portion. However, in some alternative embodiments, the cradle portion and the handle can be formed unitarily, the handle being formed as a lower connection portion of the cradle portion.

In yet additional embodiments a first aperture can be provided through the first anterior wall of the cradle portion and a second aperture can be provided through the second anterior wall of the cradle portion, wherein the second end of the first resilient member, and the second end of the second resilient member each include a flange portion configured to abut against a rim portion of a respective first or second aperture. In some such embodiments, the first resilient member can be configured to pass through the first aperture and rests on its respective flange portion thus providing tensile resistance to the first resilient member when the launcher is drawn, and wherein the second resilient member passes through the second aperture and rests on its respective flange portion thus providing tensile resistance to the second resilient member when the launcher is drawn.

It will be appreciated that the illustrative embodiment shows an embodiment in which the first resilient limb and the second resilient limb extend from the cradle portion along a primary axis, and wherein the first resilient member and the second resilient member extend from the cradle portion along a secondary axis wherein the primary axis and secondary axis are perpendicular to one another. In the illustrated embodiments, the primary axis is configured to be vertical when held by a user.

In yet additional embodiments the sling can include a plurality of apertures for restricting the minimum size of any projectiles which can be launched.

Also contemplated herein is a method of forming a concentrated mass launcher, wherein the method can include the steps of: providing a handle; providing a cradle portion above the handle, the cradle portion having a first anterior wall and a second anterior wall, the first and second anterior walls being opposed to one another and being separated from one another to form a gap; providing an upper resilient limb extending upwardly from the cradle portion, the upper resilient limb terminating at an upper distal end; providing a lower resilient limb extending downwardly from the handle, the lower resilient limb terminating at a lower distal end; providing a sling; affixing a first string to the upper resilient member so as to connect the upper distal end of the upper resilient limb to an upper portion of the sling; affixing a second string to the lower resilient member so as to connect the lower distal end of the lower resilient limb to a lower portion of the sling; providing a first resilient member being connected at a first end to the sling about a perimeter edge, and being connected at a second end to the first anterior wall of the cradle portion; and providing a second resilient member being connected at a first end to the sling about an opposing perimeter edge, and being connected at a second end to the second anterior wall of the cradle portion.

DETAILED DESCRIPTION

Figure 1:
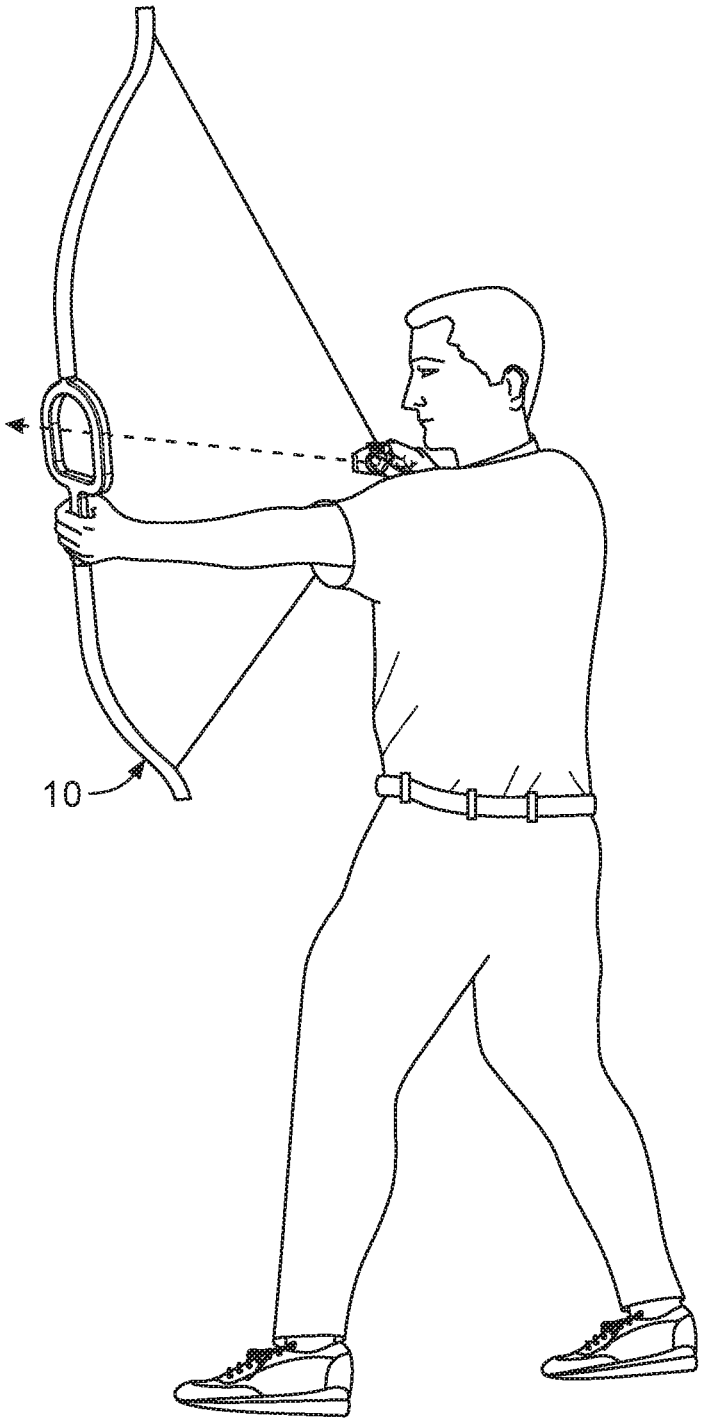
FIG. 1 illustrates a user operating a concentrated mass launcher in accordance with various aspects of the present invention.
Figure 3:
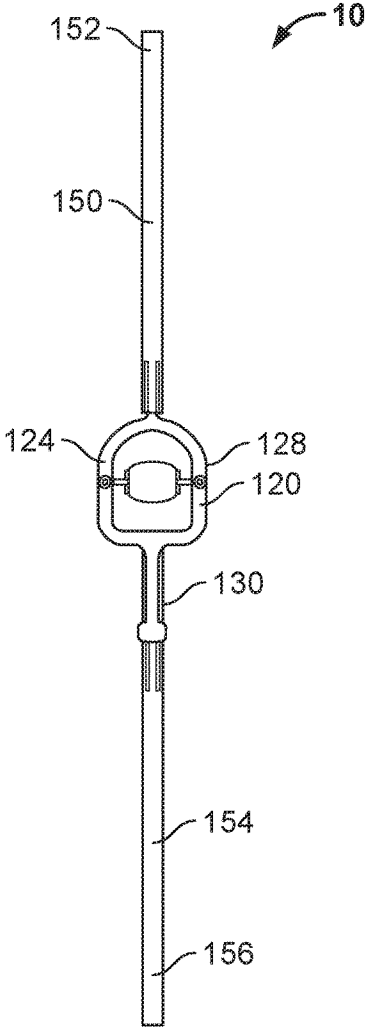
FIG. 3 illustrates a front view of a concentrated mass launcher in accordance with the embodiment of FIG. 2.

As discussed briefly above, and as shown herein in FIGS. 1-18, the present invention relates to a concentrated mass launcher 10 which is similar in construction to a standard bow configured to launch a projectile having a shaft, i.e. an arrow which spans the distance between the cradle of the bow and the string when drawn. However, the concentrated mass launcher 10 as contemplated herein has various features and changes in construction which allow for the elimination of a shaft from a projectile, and can instead shoot a concentrated mass, such as a bean bag, which can be placed or rest within a sling provided about the string.

The concentrated mass launcher 10 can include a handle portion 100, and a cradle portion 120. The concentrated mass launcher 10 can have a pair of limbs, i.e. an upper limb 150, and a lower limb 154. The upper limb 150 can extend from the cradle portion 120 and the lower limb 154 can extend downward from the handle 100. The limbs can be resilient and formed of an elastically deformable material which can be deformed under an applied force and spring back to an initial position when released. The limbs can also be rigid and formed of a more rigid material. The concentrated mass launcher 10 can further include a string 200A which connects an upper distal end 152 of the upper limb 150 to a lower distal end 156 of the lower limb 154. It will be appreciated that the string 200A (see FIG. 16B) can be unitary and extend a full distance between the upper distal end 152 all the way to the lower distal end 156, wherein the sling 250 is only attached at approximately a mid-point along the string 200A. Alternatively, the string can be split into a first string 200 provided about an upper portion of the sling 250, and a second string 210 provided about a lower portion of the sling 250. In some embodiments, the first string 200 can be provided or formed of an inelastic material which does not stretch along the length of the string.

Additionally, in some embodiments the second string 210 can be provided or formed of an elastic material which expands or stretches along a length of the string as the launcher is drawn. It will then be appreciated that the inverse can also be an alternative embodiment, where the first string 200 can be provided of an elastic material and the second string 210 can be inelastic. Further embodiments can then include elastic materials for both the first and second strings, or inelastic for both.

In this manner, the general construction of the concentrated mass launcher 10 is similar to a bow and arrow, wherein application of a rearward force to the string 200A can cause the resilient limbs to deform backward in the direction of the applied force. Then a projectile can be affixed to the string and upon release of the string, the elastic return of the resilient limbs can cause the string to move forward at a rapid rate, thus launching the projectile.

Figure 2:
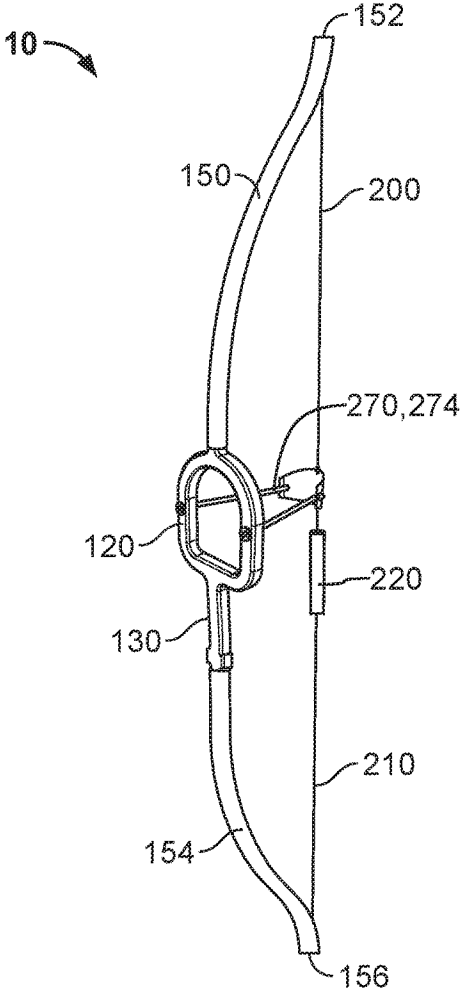
FIG. 2 illustrates a front perspective view of a concentrated mass launcher in accordance with various aspects of the present invention.
Figure 4:
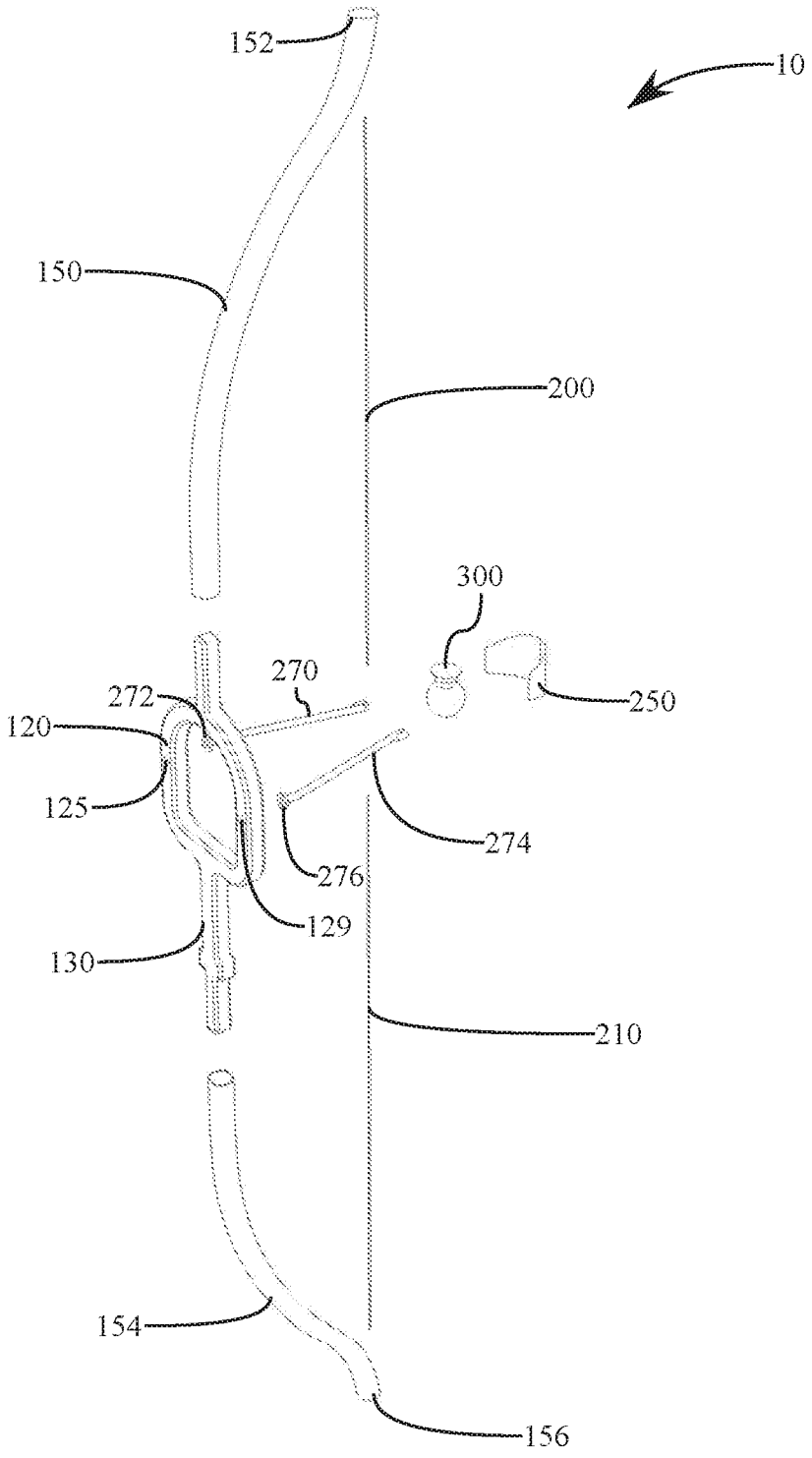
FIG. 4 illustrates a front perspective exploded view of a concentrated mass launcher in accordance with the embodiment of FIG. 2.
Figure 5:
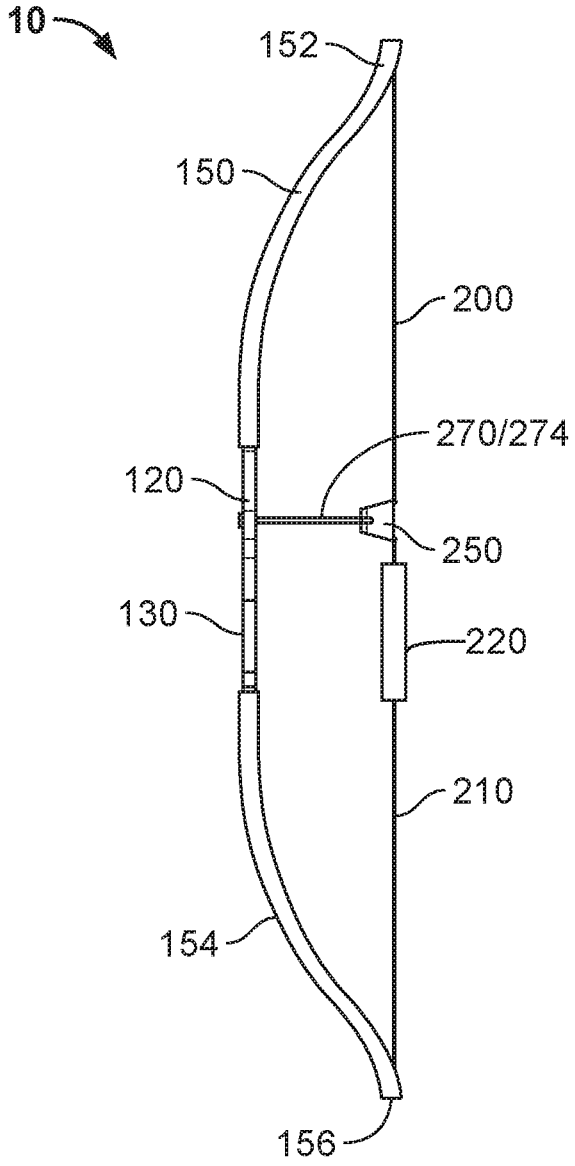
FIG. 5 illustrates a side view of a concentrated mass launcher in accordance with the embodiment of FIG. 2.
Figures 6A, 6B, 6C, 6D, 6E, 6F, 6G, 6H, 6I:
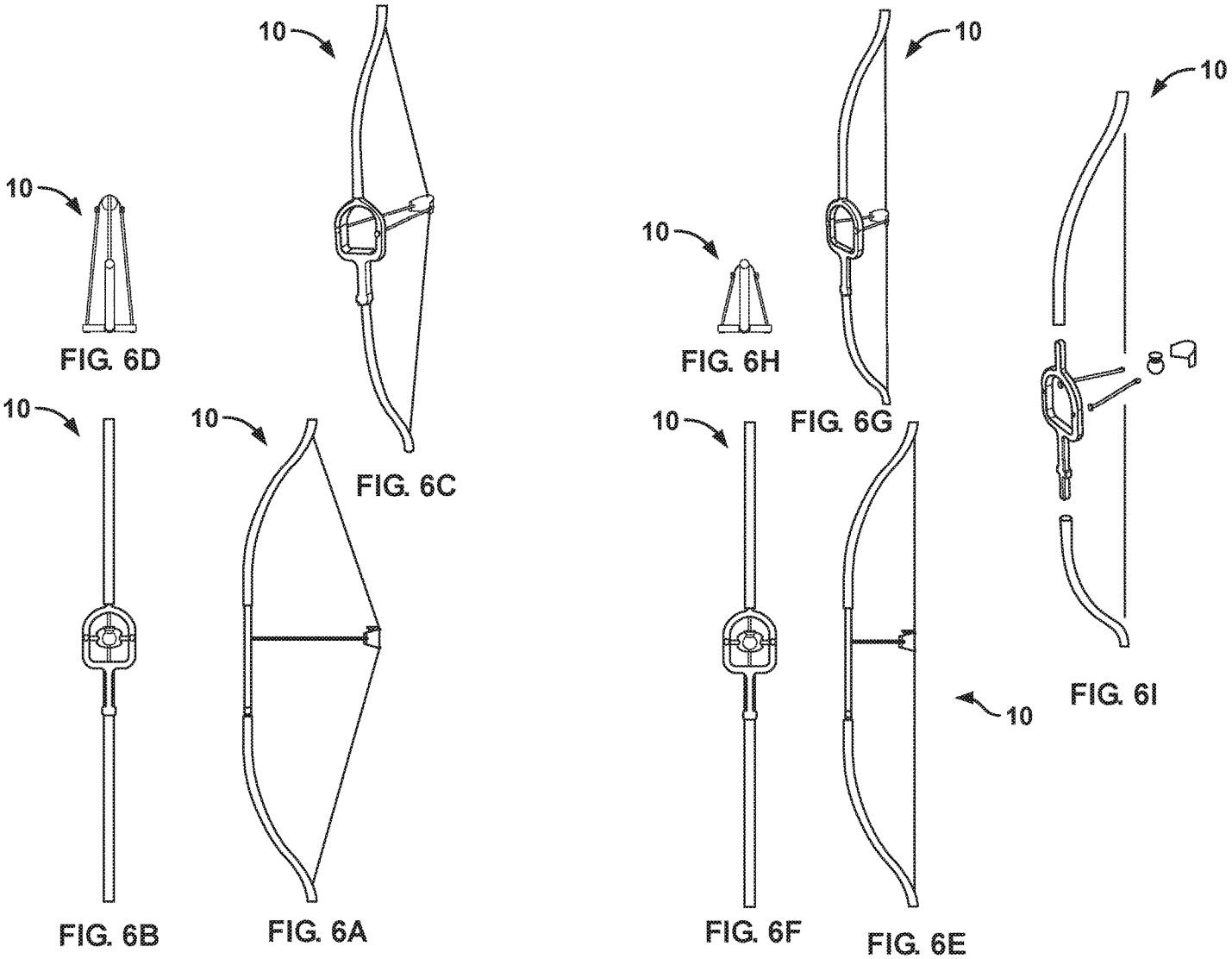
FIG. 6A-D illustrates top, perspective, front, and side views of the concentrated mass launcher in accordance with the embodiment of FIG. 2 in a drawn configuration.
FIG. 6E-I illustrates top, perspective, front, side, and exploded perspective views of the concentrated mass launcher in accordance with the embodiment of FIG. 2 in a resting configuration.
Figure 8:
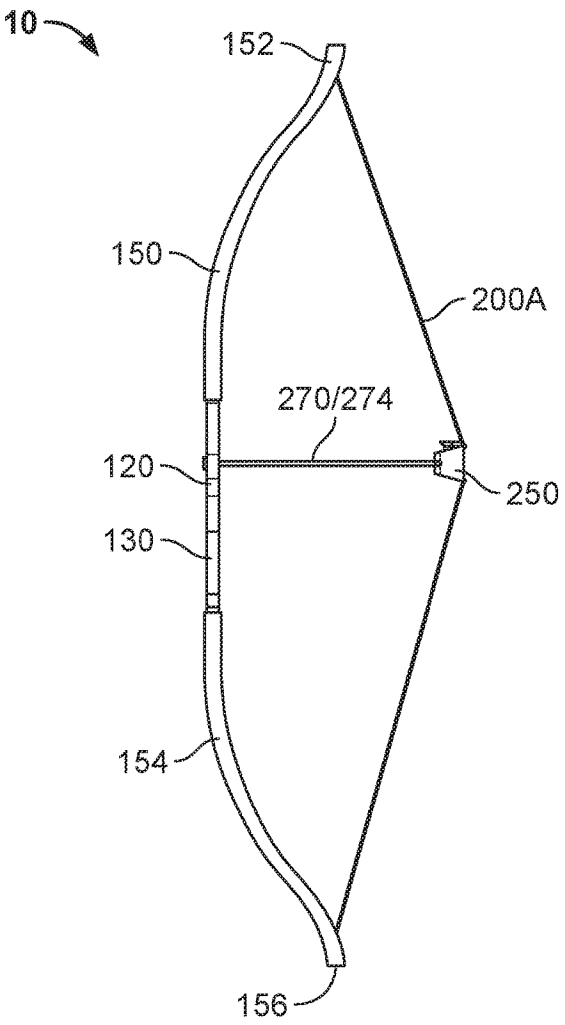
FIG. 8 illustrates a side view of a concentrated mass launcher in accordance with the embodiment of FIG. 2 in a drawn configuration.
Figure 7:
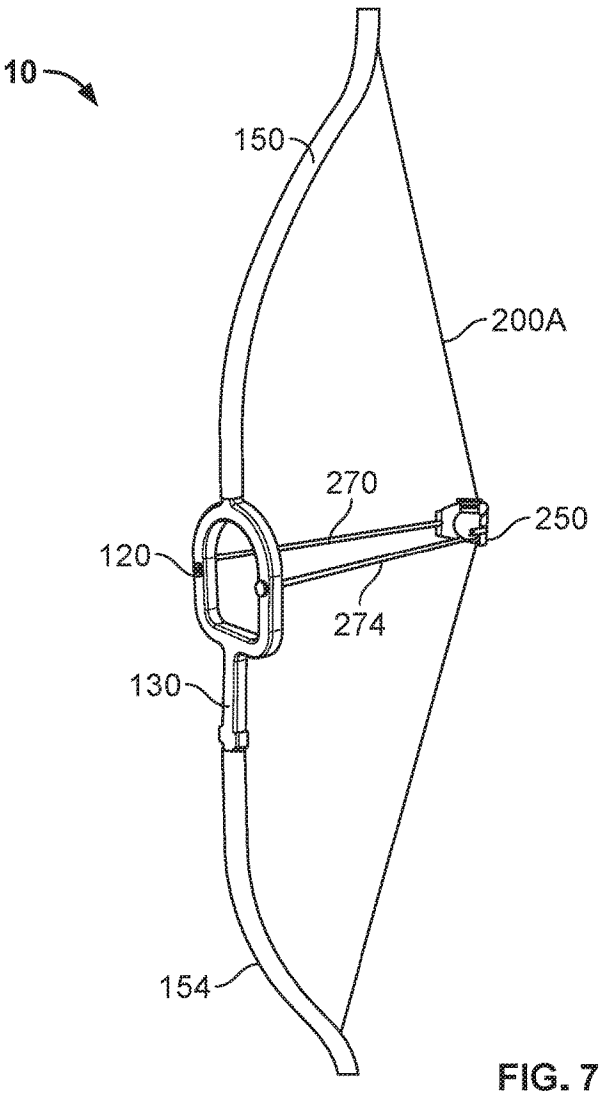
FIG. 7 illustrates a front perspective view of a concentrated mass launcher in accordance with the embodiment of FIG. 2 in a drawn configuration.
Figure 9:
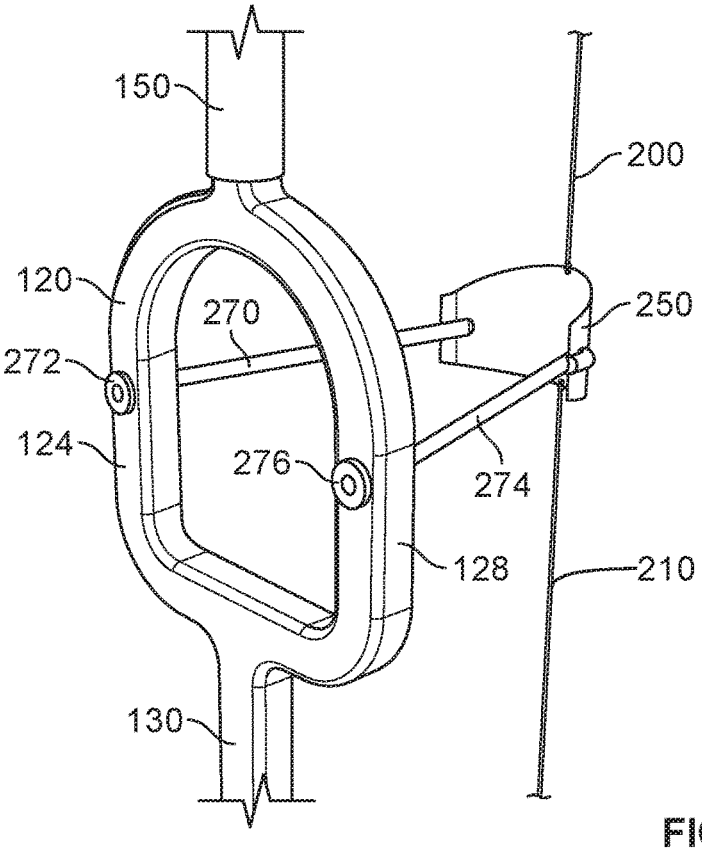
FIG. 9 illustrates a front perspective view of a cradle and handle portion of the concentrated mass launcher in accordance with the embodiment of FIG. 2.
Figure 10:
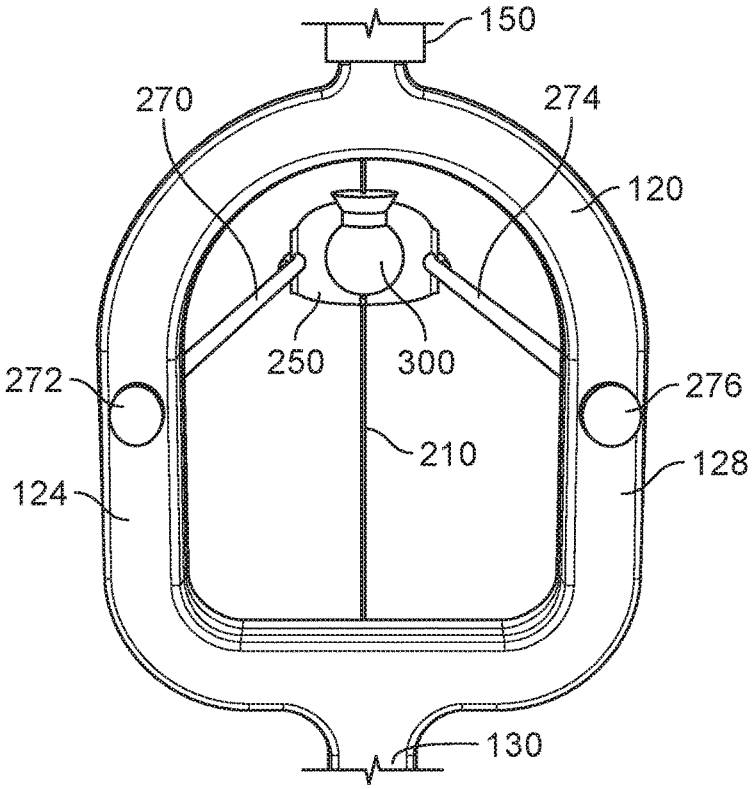
FIG. 10 illustrates a front perspective view of a cradle and sling portion of the concentrated mass launcher in accordance with the embodiment of FIG. 2, with a bulbous mass in the sling.
Figure 11:
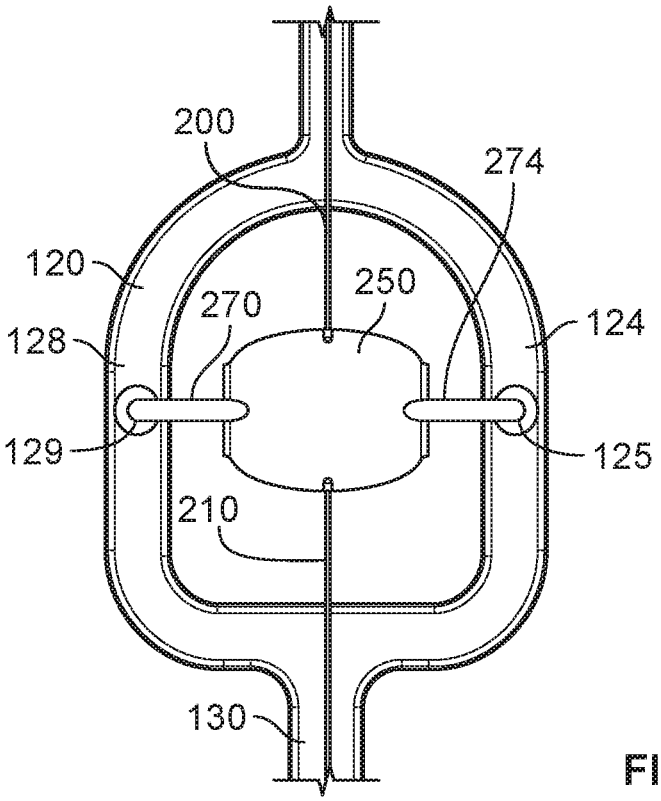
FIG. 11 illustrates a rear view of a cradle and sling portion of the concentrated mass launcher in accordance with the embodiment of FIG. 2.
Figure 12:
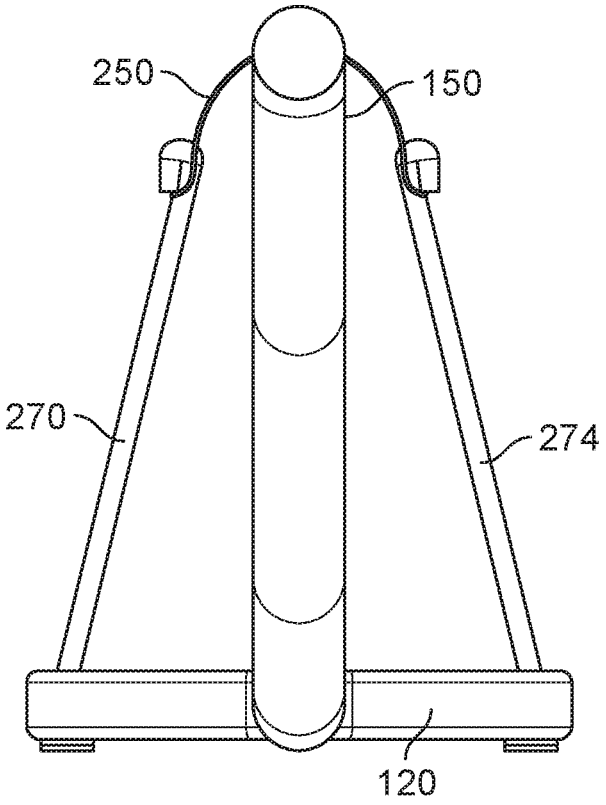
FIG. 12 illustrates a top view of a cradle and sling portion of the concentrated mass launcher in accordance with the embodiment of FIG. 2 in a rest position.
Figure 13:
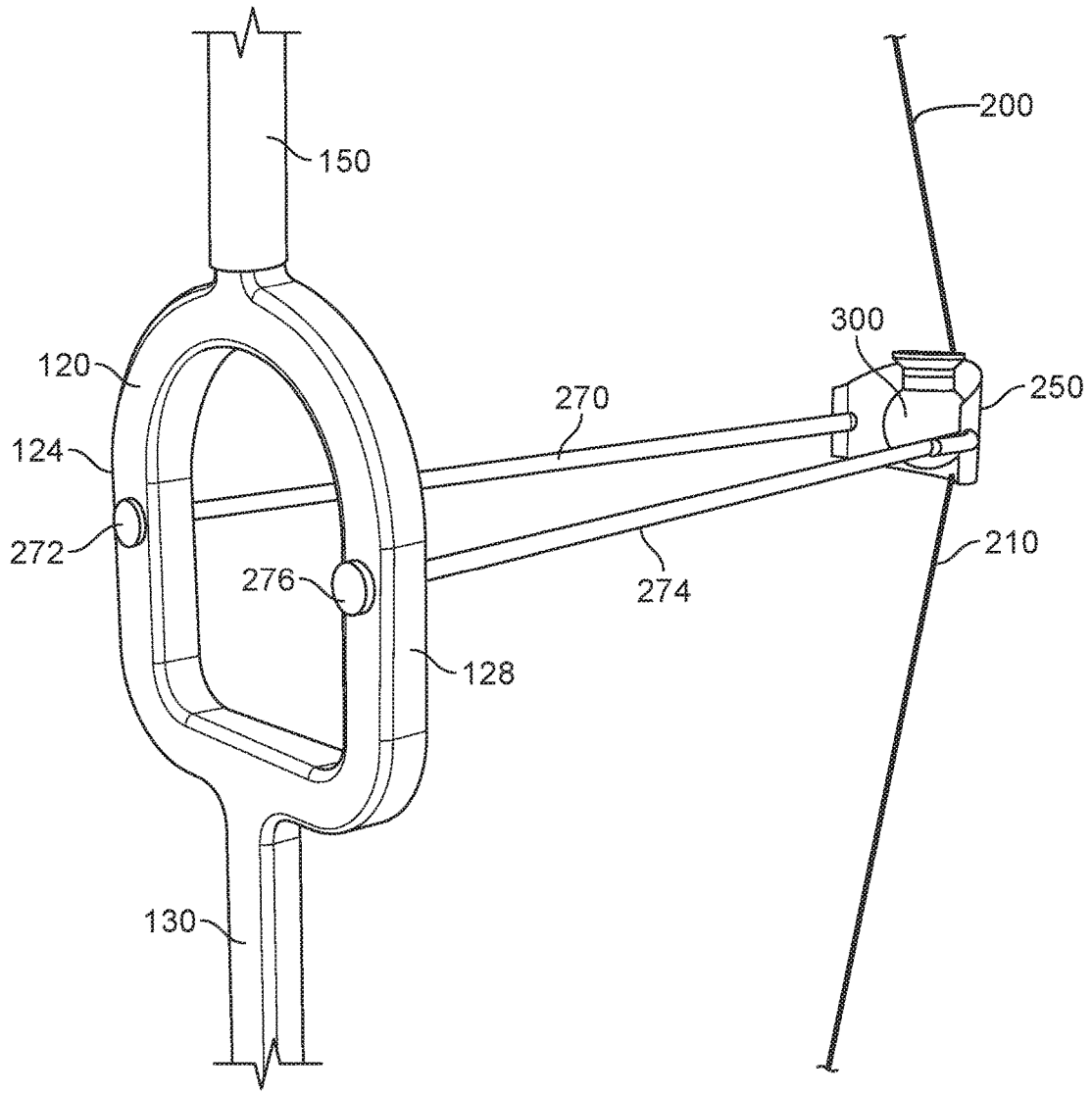
FIG. 13 illustrates a front perspective view of a cradle and handle portion of the concentrated mass launcher in accordance with the embodiment of FIG. 2 in a drawn position with the bulbous mass in the sling.
Figure 14:
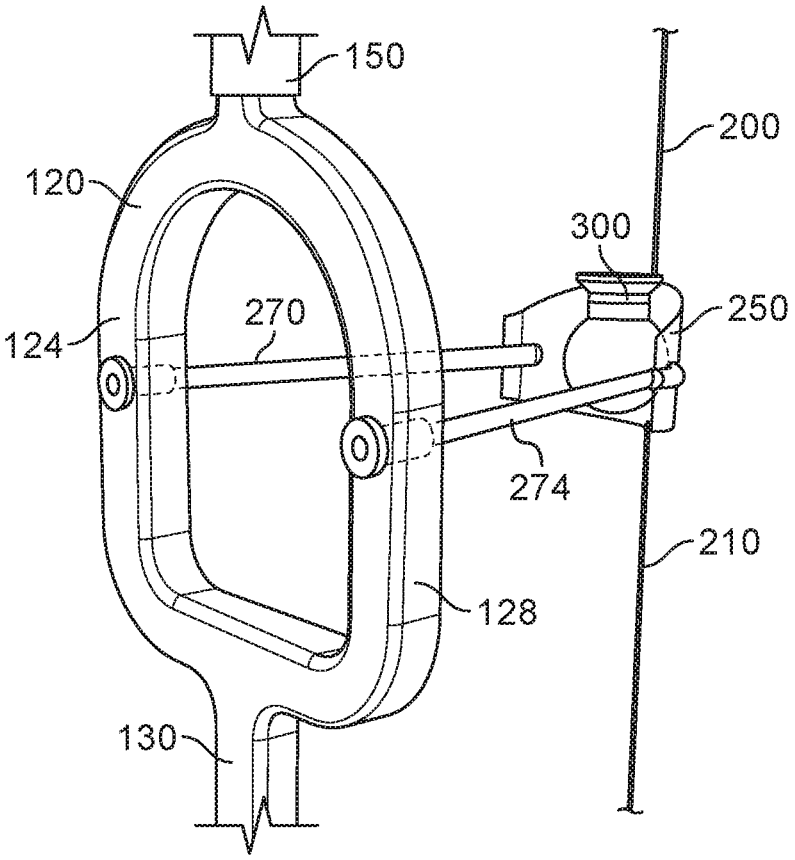
FIG. 14 illustrates a front perspective view of a cradle and handle portion of the concentrated mass launcher in accordance with the embodiment of FIG. 2 in a rest position.
Figure 15:
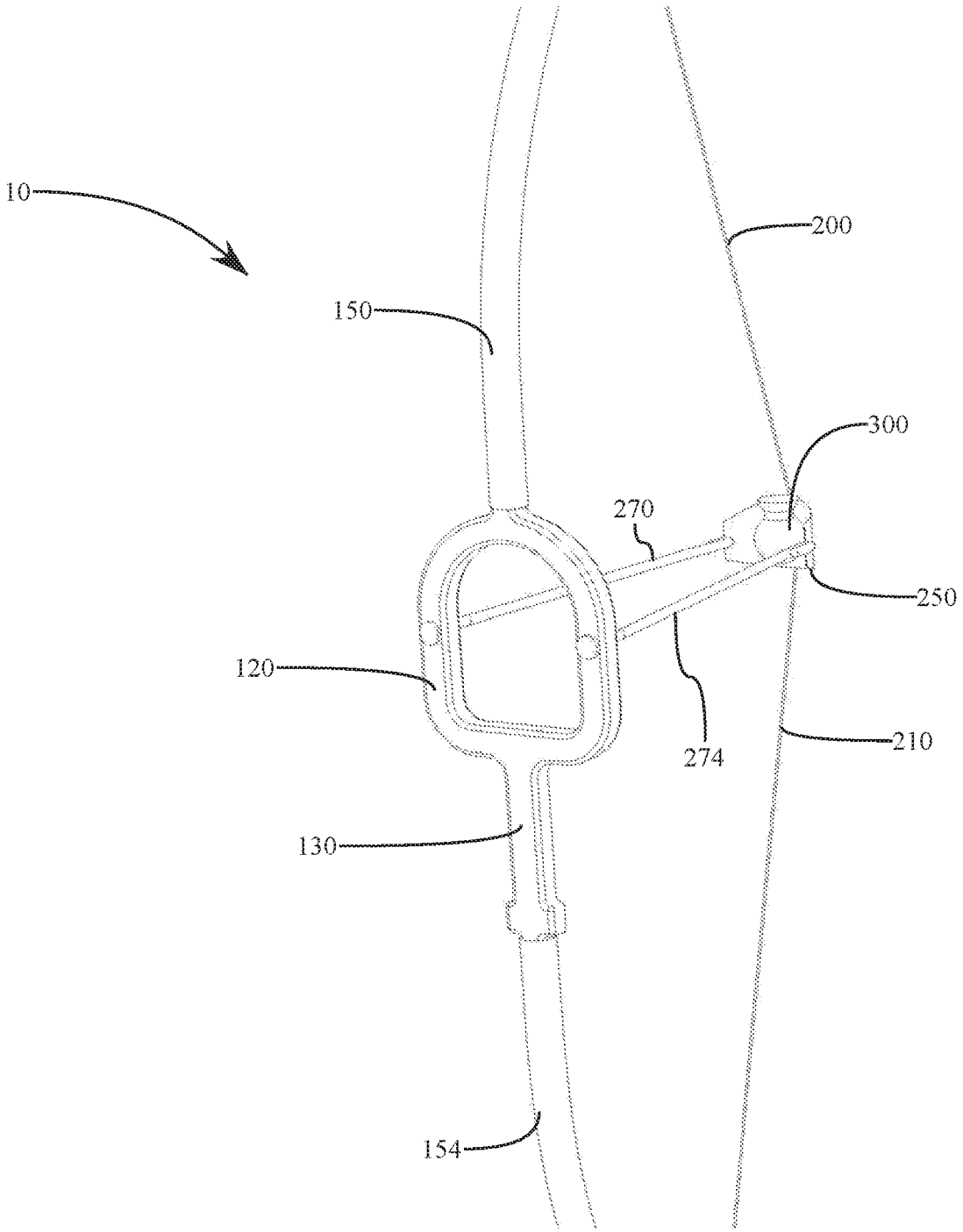
FIG. 15 illustrates a front perspective view of the concentrated mass launcher in accordance with the embodiment of FIG. 2 in a partially drawn position.
Figure 16A:
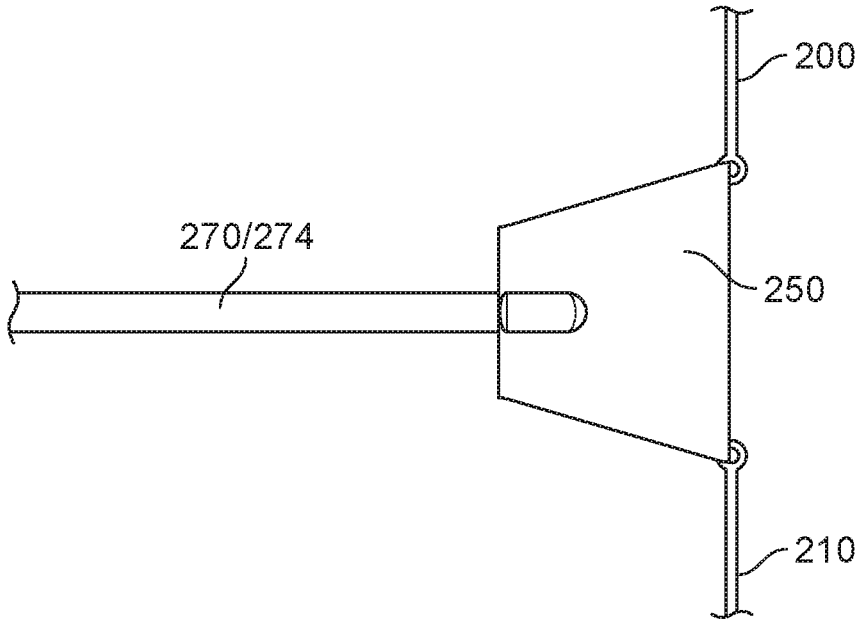
FIG. 16A illustrates a side view of the sling portion of the concentrated mass launcher in accordance with the embodiment of FIG. 2 illustrating a first embodiment of a string configuration.
Figure 16B:
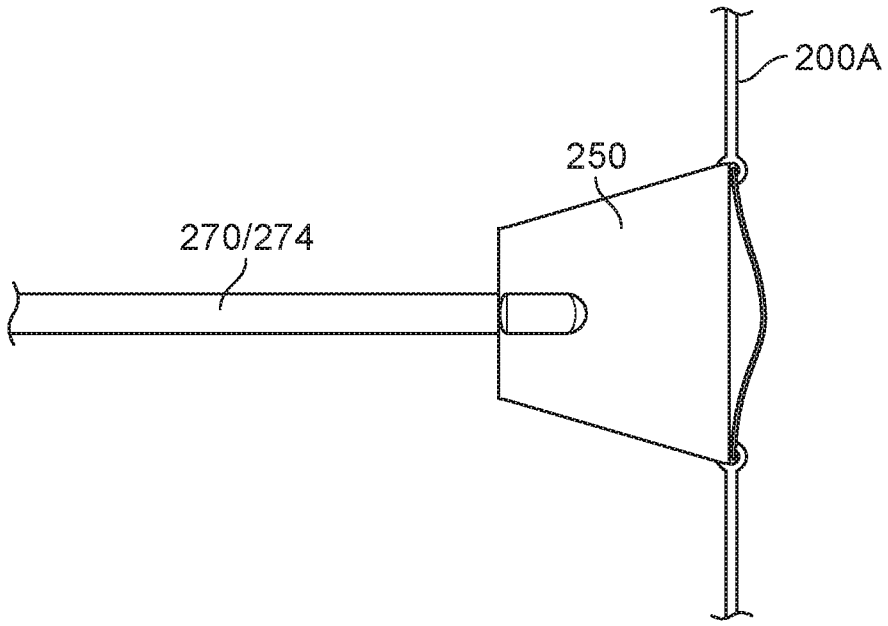
FIG. 16B illustrates a side view of the sling portion of the concentrated mass launcher in accordance with the embodiment of FIG. 2 illustrating a second embodiment of a string configuration.
Figure 17:
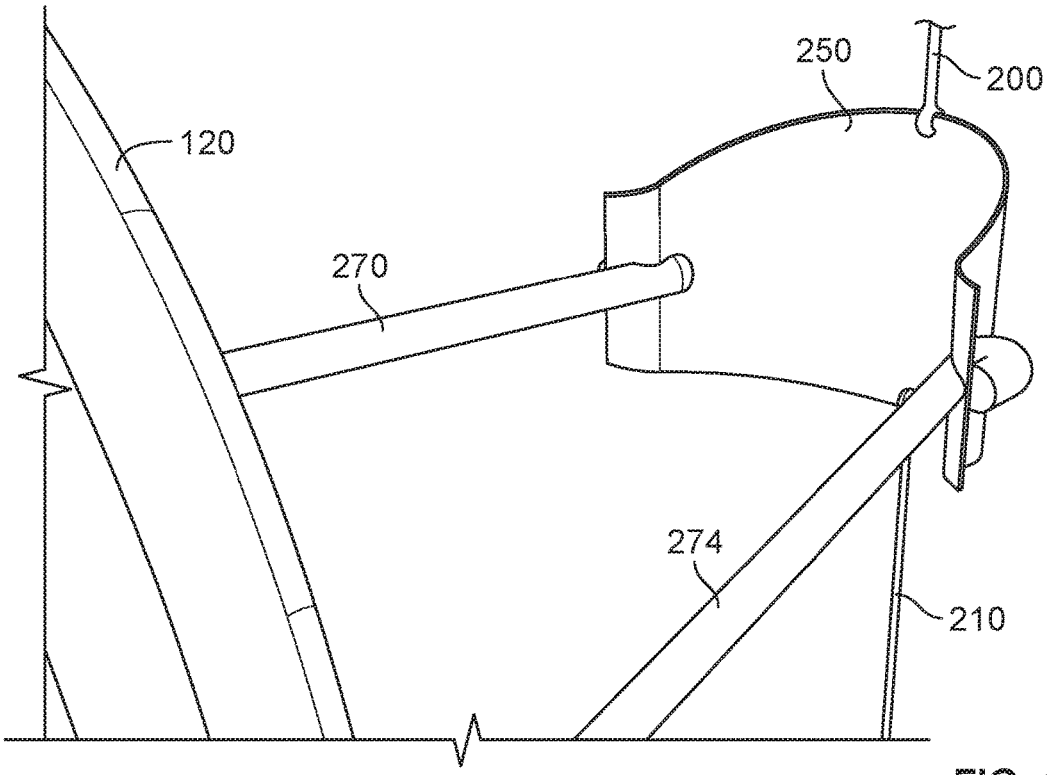
FIG. 17 illustrates a front perspective view of a sling of the concentrated mass launcher in accordance with the embodiment of FIG. 16A.
Figure 18:
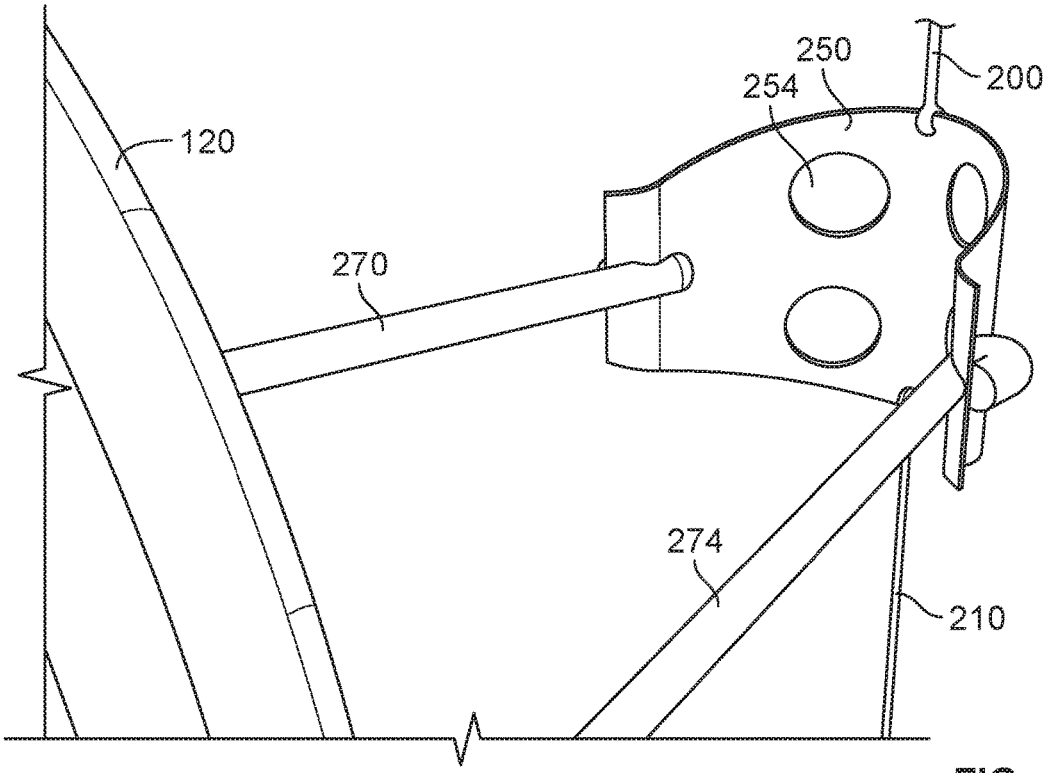
FIG. 18 illustrates a front perspective view of an alternative sling for use with a concentrated mass launcher in accordance with any of the aforementioned embodiments.

An arm guard 220 can be placed below the sling 250 on either string 200A or string 210, as shown in FIG. 2. The arm rest can be constructed of a soft or supple material, such as foam, so that it prevents a direct interaction of the string with a user's forearm. The released and uncovered string striking a forearm could result in some discomfort to the user, thus arm guard 220 facilitates a less discomforting interaction as the supple, bulkier, and softer arm guard can dampen or reduce any potential painful interaction.

In most bow and arrow systems the bow is provided with a rest, which is typically a C-shaped section through which the arrow passes. The present invention, i.e. concentrated mass launcher 10, allows for the launching of bulbous or concentrated projectiles through the cradle portion 120 above the handle. The cradle portion 120 can include opposing anterior members or walls 124 and 128. These opposing anterior walls can have a flared cross-section flaring radially outward from a center line of the handle and resilient members so as to create a large gap through which a projectile can travel upon launch.

It will be appreciated that in the embodiment shown both of the opposing anterior walls flare out and then back in from the top to the bottom so as to create solid connection points onto which the handle and upper resilient limb can attach. However, it will be appreciated that one of the opposing anterior walls can also be incomplete so as to leave a portion of the circumference of the large gap can be left open. However, the closed configuration, as shown, provides increased strength and stability.

In order to facilitate the launching of a shaft-less, concentrated, and/or bulbous mass, i.e. 300, a pouch or sling 250 can be provided on the string 200A which can transmit the forward motion and force of the string to the projectile. The sling 250 can be designed to hold a concentrated mass such as a bag with granular mass, i.e. beans or sand, a water balloon, balls or another small mass.

In order to increase accuracy and ensure proper separation from the mass 300 and the sling 250, the sling 250 can be provided with a first resilient member 270 being connected at a first end to the sling about a perimeter edge, the resilient member also being connected at a second end to the first anterior wall 124 of the cradle portion 120. Additionally, a second resilient member 274 can be connected at a first end to the sling 250 about an opposing perimeter edge, and be connected at a second end to the second anterior wall 128 of the cradle portion 120. In this manner, the resilient members 270 and 274 can strength axially when the string 200A is drawn in a rearward direction into the drawn position. Then when the sling 250 is released the resilient members 270 and 274 can maintain the pouch in an open and forward position. Additionally, the resilient members will help direct the sling 250 in a proper forward motion so as to direct the mass 300 through the gap of the cradle portion 120. It will be appreciated that the resilient members 270 and 274 can be maintained in a tight or taught manner in both the rest and drawn positions.

In some additional embodiments the cradle portion 120 can be provided with first and second apertures 125 and 129 provided through their respective first and second anterior walls 124 and 128. These apertures can act as stops such that the resilient members 270 and 274 can pass therethrough and can either be tied or affixed using alternative means. One exemplary embodiment of the resilient members provides flange portions 272 and 276 which interfere with the rim of the apertures 125 and 129 as the resilient members pass therethrough, thus allowing a tensile force to be applied to the resilient members without pulling the respective flange portions through the apertures when the string of the launcher is drawn. It will be appreciated that alternative attachment means exists which can also include providing a channel around the exterior circumference of each of the first and second anterior walls, about which the resilient members can be tied in an accurate and repeatable fashion.

It will be appreciated that bulbous masses such as sand or bean bags can be used. Additionally, it will be appreciated the preferential projectiles include inert items such as light balls, water balloons, etc. In order to reduce the risk of non-inert projectiles, such as marbles, ball bearings, or other overly dense, and potentially hazardous items, a plurality of apertures 254 can be provided to the sling 250. These apertures 250 can be sized appropriately such that small dense items, such as marbles or ball bearings, would pass therethrough and as such not be able to be launched by the launcher 10 contemplated herein.

It will be further understood that various materials, such as plastics, polymers, composites, wood, or metal can be used to form the various parts of the launcher 10, and in particular the resilient upper and lower members 150 and 154.

In some embodiments, it has been recognized that strength and stability can be increased by forming a handle 130 and a cradle portion 120 out of a unitary construction, particularly of composite materials having fibers embedded therein which extend the effective length of the unitary structure avoiding the need for various joints and the potential for failure of each respective joint or connection point.

As such the concentrated mass launcher 10 allows for the use of concentrated masses 300 which are easy to transport in large quantities, and also do not require special packaging or mounts so as to maintain shaft integrity.

In addition to differing materials, those having skill in the art will readily understand that the resilient members can be replaced with resilient members of varying orientation and construction. For example, a cam system commonly used for compound bows can replace the resilient upper and lower members.

The above description is merely illustrative. Having thus described several aspects of at least one embodiment of this invention including the preferred embodiments, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawing are by way of example only.

The invention claimed is:

1. A concentrated mass launcher, the launcher comprising:

a handle;

a cradle portion having a first anterior wall and a second anterior wall, the first and second anterior walls being opposed to one another and being separated from one another to form a gap, the cradle portion being positioned above the handle;

an upper resilient limb extending upwardly from the cradle portion, the upper resilient limb terminating at an upper distal end;

a lower resilient limb extending downwardly from the handle, the lower resilient limb terminating at a lower distal end;

a sling;

a first string extending from the upper distal end of the upper resilient limb toward the cradle portion, the first string connecting to an upper portion of the sling;

a second string extending from the lower distal end of the lower resilient limb toward the cradle portion, the second string connecting to a lower portion of the sling;

a first resilient member being connected at a first end to the sling about a perimeter edge, and being connected at a second end to the first anterior wall of the cradle portion; and a second resilient member being connected at a first end to the sling about an opposing perimeter edge, and being connected at a second end to the second anterior wall of the cradle portion.

2. The concentrated mass launcher of claim 1, wherein the first string is formed from an inelastic material being rigid along a primary axis of the first string.

3. The concentrated mass launcher of claim 2, wherein the second string is formed of an elastic material having elastic properties along a primary axis of the second string.

4. The concentrated mass launcher of claim 1, wherein the second string is formed of an elastic material having elastic properties along a primary axis of the second string.

5. The concentrated mass launcher of claim 1, wherein the sling is aligned with the gap of the cradle portion in a resting state.

6. The concentrated mass launcher of claim 1, wherein the first anterior wall and the second anterior wall each have an upper and lower connection portion which connect to the upper resilient member at the upper connection portion and connect to the handle at a lower connection portion.

7. The concentrated mass launcher of claim 1, wherein the cradle portion and the handle are formed unitarily, the handle being formed as a lower connection portion of the cradle portion.

8. The concentrated mass launcher of claim 1, further comprising:

a first aperture provided through the first anterior wall of the cradle portion;

a second aperture provided through the second anterior wall of the cradle portion; and wherein the second end of the first resilient member, and the second end of the second resilient member each include a flange portion, wherein the first resilient member passes through the first aperture and rests on its respective flange portion thus providing tensile resistance to the first resilient member when the launcher is drawn, and wherein the second resilient member passes through the second aperture and rests on its respective flange portion thus providing tensile resistance to the second resilient member when the launcher is drawn.

9. The concentrated mass launcher of claim 1, wherein the first resilient limb and the second resilient limb extend from the cradle portion along a primary axis, and wherein the first resilient member and the second resilient member extend from the cradle portion along a secondary axis.

10. The concentrated mass launcher of claim 9, wherein the primary axis and secondary axis are perpendicular to one another.

11. The concentrated mass launcher of claim 9, wherein the primary axis is configured to be vertical when held by a user.

12. The concentrated mass launcher of claim 1, wherein the sling further comprises a plurality of apertures.

13. A method of forming a concentrated mass launcher, the method comprising:

providing a handle;

providing a cradle portion above the handle, the cradle portion having a first anterior wall and a second anterior wall, the first and second anterior walls being opposed to one another and being separated from one another to form a gap;

providing an upper resilient limb extending upwardly from the cradle portion, the upper resilient limb terminating at an upper distal end;

providing a lower resilient limb extending downwardly from the handle, the lower resilient limb terminating at a lower distal end;

providing a sling;

affixing a first string to the upper resilient member so as to connect the upper distal end of the upper resilient limb to an upper portion of the sling;

affixing a second string to the lower resilient member so as to connect the lower distal end of the lower resilient limb to a lower portion of the sling;

providing a first resilient member being connected at a first end to the sling about a perimeter edge, and being connected at a second end to the first anterior wall of the cradle portion; and providing a second resilient member being connected at a first end to the sling about an opposing perimeter edge, and being connected at a second end to the second anterior wall of the cradle portion.

14. The method of forming a concentrated mass launcher of claim 13, wherein the first string is formed from an inelastic material being rigid along a primary axis of the first string.

15. The method of forming a concentrated mass launcher of claim 14, wherein the second string is formed of an elastic material having elastic properties along a primary axis of the second string.

16. The method of forming a concentrated mass launcher of claim 13, wherein the second string is formed of an elastic material having elastic properties along a primary axis of the second string.

17. The method of forming a concentrated mass launcher of claim 13, further comprising:

providing a first aperture through the first anterior wall of the cradle portion;

providing a second aperture through the second anterior wall of the cradle portion;

affixing the second end of the first resilient member through the first aperture; and affixing the second end of the second resilient member through the second aperture.

18. The method of forming a concentrated mass launcher of claim 13, further comprising:

providing a plurality of apertures through the sling.

19. A concentrated mass launcher, the launcher comprising:

a handle;

a cradle portion having a first anterior wall and a second anterior wall, the first and second anterior walls being opposed to one another and being separated from one another to form a gap, the cradle portion being positioned above the handle;

an upper resilient limb extending upwardly from the cradle portion, the upper resilient limb terminating at an upper distal end;

a lower resilient limb extending downwardly from the handle, the lower resilient limb terminating at a lower distal end;

a sling;

a first string extending from the upper distal end of the upper resilient limb toward the cradle portion, the first string connecting to an upper portion of the sling;

a second string extending from the lower distal end of the lower resilient limb toward the cradle portion, the second string connecting to a lower portion of the sling;

a first resilient member being connected at a first end to the sling about a perimeter edge, and being connected at a second end to the first anterior wall of the cradle portion;

a second resilient member being connected at a first end to the sling about an opposing perimeter edge, and being connected at a second end to the second anterior wall of the cradle portion;

wherein the first string is formed from an inelastic material being rigid along a primary axis of the first string;

wherein the second string is formed of an elastic material having elastic properties along a primary axis of the second string;

a first aperture provided through the first anterior wall of the cradle portion, the first aperture being configured to attach to the first resilient member;

a second aperture provided through the second anterior wall of the cradle portion, the second aperture being configured to attach to the second resilient member; and wherein the sling further comprises a plurality of apertures.

* * * * *